US005178655A

United States Patent [19]

Sassier

[11] Patent Number: 5,178,655

[45] Date of Patent: Jan. 12, 1993

[54] VACUUM CLEANING DEVICE

[76] Inventor: Gérard Sassier, Domaine de Ricardelette, 11100 - Narbonne, France

[21] Appl. No.: 768,891

[22] PCT Filed: Feb. 26, 1991

[86] PCT No.: PCT/FR91/00157

§ 371 Date: Oct. 25, 1991

§ 102(e) Date: Oct. 25, 1991

[87] PCT Pub. No.: WO91/12762

PCT Pub. Date: Sep. 5, 1991

[30] Foreign Application Priority Data

Feb. 27, 1990 [FR] France ..... 90 02449

[51] Int. Cl.[5] ..... B01D 46/00

[52] U.S. Cl. ..... 55/341.2; 55/429; 55/483; 55/502

[58] Field of Search ..... 55/341.2, 429, 483, 55/502

[56] References Cited

U.S. PATENT DOCUMENTS

| | | | |
|---|---|---|---|
| 2,044,827 | 6/1936 | Adams | 55/429 |
| 3,422,602 | 1/1969 | Janson | 55/502 |
| 3,906,756 | 9/1975 | Bone | 55/429 |
| 3,910,781 | 10/1975 | Bryant, Jr. | 55/305 |
| 4,222,753 | 9/1980 | Mills | 55/274 |

FOREIGN PATENT DOCUMENTS

| | | |
|---|---|---|
| 3723148 | 1/1989 | Fed. Rep. of Germany . |
| 787871 | 9/1935 | France . |
| 409266 | 9/1966 | Switzerland . |
| 865262 | 4/1961 | United Kingdom . |

*Primary Examiner*—Bernard Nozick

*Attorney, Agent, or Firm*—Cushman, Darby & Cushman

[57] ABSTRACT

A vacuum cleaning device comprising an enclosure (20) containing a chamber (30) in which is located at least one flexible wall such as a bag (2) designed to stop solid particles while letting through the air, and containing a compartment (40) provided with a movable tray (41) located beneath the chamber (30) in order to catch the solid particles which fall by the force of gravity. The device is characterized in that it includes a means (5) for forming a sealed connection between the flexible wall (2) and the tray (41), the latter comprising at least one inlet (48–49) for air to be filtered. In a preferred embodiment, the flexible wall (2) is secured by frame (3) the edge of which acrries a flexible seal (5) so that the assembly (1) thereby formed is self-contained and interchangeable without needing to be dismantled.

11 Claims, 2 Drawing Sheets

VACUUM CLEANING DEVICE

Many cleaning devices meant to evacuate solid particles, such as dust, waste, and so forth, by suction are known.

All of them include a motor and a turbine that brings about negative pressure in a hose, one end of which must be placed in front of the zone to be cleaned and the other of which is located at the inlet to a chamber containing at least one flexible wall, such as a bag, through which the turbine aspirates the air and which plays the role of a filter, because it retains the solid particles while allowing the air aspirated by the turbine to pass through.

The flexible wall is generally disposed vertically on a reinforcement having an opening in its lower part, located on top of a recovery bin into which the solid particles not stuck to the flexible wall drop by gravity. When the flexible wall is cleaned or replaced, it is primed by being shaken, to cause the maximum amount of particles and dust to drop into the recovery bin.

The bin is mounted movably in a compartment from which it is removed to empty its contents.

The dust-laden air is introduced into the compartment, and to avoid excessive suction losses this compartment is closed by means of a door that is pressed against a frame, in between which a sealing gasket is interposed.

Such a structure proves unsatisfactory, for various reasons:

For simple geometrical reasons, the recovery bin cannot occupy precisely the entire interior volume of the compartment, because some play must be provided to enable movements of the bin, which is movable with respect to the fixed compartment. As a result, solid particles drop outside the bin into the compartment, rather than into the interior. These particles accumulate and finally create piles, which as they grow eventually impede the movements of the bin.

The bin is thus forced back little by little, and a time comes when the door of the compartment cannot be closed except by forcing the bin, and then, as circumstances necessarily become worse, it becomes impossible to close the door. The bin must then be removed and the compartment cleaned by hand, which is a difficult operation.

The successive openings and closing of the door quite naturally cause wear of the gasket, whose efficiency is degraded until such time as it must be replaced. For reasons of economy, however, one waits as long as possible before changing the gasket, so that little by little and one might say imperceptibly, the seal lessens, so that the turbine aspirates external air through the spaces not closed by the door, instead of aspirating the air laden with dust exclusively by the hose. In practice, this can cause an up to 80% loss in efficiency of the equipment.

The flexible wall or bag is fixed to a frame by means of bolts, which are a hindrance to easy removal of the bag for cleaning or replacement. Moreover, the bag must be removed and reinserted via the upstream side of the system, that is, the dirty side that is dusty from the dust-laden air, making it a toilsome operation.

To define the prior art, the following may be cited:

British Patent A 865,262, which describes a vacuum cleaner including a bin that contains a dust bag, and a lid surmounting the bin and bag assembly, inside which a filtering wall is disposed.

This filtering wall is kept in shape by a complex reinforcement so that it can be kept taut.

A sealing gasket that may be supported by the lid or bin is disposed between the lid and the top of the bin.

Hooks that pivot on articulated parts fastened to the bin cooperate with holes made in the lid, to assure the closure of the vacuum cleaner and to hold the bin against the sealing gasket.

Because of the presence of a dust bag disposed in the bin, a not-insignificant proportion of the dust drops outside the bag, since there is a lack of a seal between the bag and the bin. The result is soiling of the bin, which necessitates its cleaning simultaneously with the cleaning of the bag. Moreover, the filter is fastened to a complex metal reinforcement, which causes it to wear down by friction.

U.S. Pat. No. 2,044,827, which describes a vacuum cleaner including an upper housing inside which a filtering wall that is completely independent from a dust bin at the bottom is fastened to a complex reinforcement. The result is major wear of the filtering wall by friction.

Moreover, this vacuum cleaner lacks any means to ensure a good seal between the filter, the dust bin and the compartment containing the bin; this causes major losses of suction that considerably reduce efficiency.

Swiss Patent 409,266, which describes an industrial vacuum cleaner that in its lower portion includes a dust bin that is equivalent to a garbage can. This dust bin is mounted to be movable from bottom to top via a plate associated with a stirrup. The upper portion of the vacuum cleaner includes a filter retained on a complex reinforcement, entirely independently of the bin.

This receptacle is mounted to be movable from bottom to top via complex mechanical means that do not assure a correct, direct seal between the filter and the receptacle. Moreover, the filter is fixed to metal reinforcements in such a way that it undergoes major strains and wears down.

This equipment includes a sealing gasket between an intermediate fixed part and a lower removable part; the gasket is subject to the mechanical strains ensuing from the successive insertions and removals of the receptacle. The result is a less-tight seal and hence reduced performance of the equipment because of a suction loss.

German Patent A 3.723.148 describes a cleaning device the upper part of which includes filtration means and the lower part of which includes a bin containing a removable dust bag that is mounted to be movable from bottom to top.

This bin is fixed via a complex assembly of mechanical parts pivotably connected to the upper portion when the device is in the functional position.

U.S. Pat. No. 4,222,753, which describes a vacuum cleaning device including a bin without an air inlet, surmounted by a part that includes a filter. This filter is retained in its base by a metal part associated with a spring that exerts a radial force, which accentuates the mechanical forces borne by the filter and hence causes its wear or even destruction.

Furthermore, the lower portion is constituted by a bin containing a bag that does not prevent the accidental drop of dust between it and the bin, and there is no sealed mechanical connection whatever with the filter.

Moreover, this device includes no means that assures a tight seal between the bin and the part surmounting it, and hence the device cannot furnish satisfactory performance in terms of efficiency.

U.S. Pat. Nos. 3,910,781 and 4,222,753 describe a vacuum cleaner including a filter that is fixed and retained by a complex metal structure associated with springs. The result is increased wear of the filter.

The present invention overcomes all these disadvantages by providing a novel structure and the inlet of the device, which makes it possible to guarantee maximum efficiency for the device by eliminating the causes of leakage and suction loss.

Furthermore, this device enables the following:

assuring a direct and total seal between the filter and the bin;

eliminating the access doors to the compartment containing the bin;

assuring absolute cleanliness of the compartment inside which the dust bin is located.

To this end, the subject of the invention is a vacuum cleaning device of the type comprising an enclosure including on the one hand a chamber in which at least one flexible wall is located, such as a bag intended to stop solid particles while allowing the aspirated air to pass through, and on the other hand, a compartment intended to contain a removable bin located under the chamber and intended to collect the solid particles that can drop by gravity, characterized in that it includes sealed linking means such as a peripheral flexible gasket fastened to the flexible wall and which assures a direct, tight linkage between said wall and the bin, the latter including at least one air inlet.

In other characteristics of the invention:

the flexible wall and the gasket are separable from one another;

the flexible wall and the gasket are inseparable and form an assembly that is interchangeable with some other similar one;

the flexible wall and the bin are mounted movably one with respect to the other so that they can occupy two relative positions, in one of which they are separated so that they can be displaced individually, and in the other of which they are pressed against one another in a sealed manner;

the bin is mounted movably in the compartment, on the one hand horizontally in the manner of a drawer and on the other vertically so as to be capable of being pressed by its periphery against a gasket solidly joined to the flexible wall, means being provided to hold said gasket against the bin;

the means for holding the gasket against the bin are constituted by at least one stop provided in the chamber;

the stop is constituted by a frame formed of angle irons fixed to the walls of the chamber, the peripheral gasket solidly attached to the flexible wall being intended to be placed against said frame, between it and the bin;

the bin has at least two ramps fixed to the outside of two opposed side walls, at a level slightly lower than the apex of corresponding stops located inside the compartment;

the stops are constituted by pivotably mounted rollers;

it includes a drawer that is independent of the bin and constitutes a solid, removable bottom of the compartment.

The invention will be better understood by the ensuing detailed description, taken in conjunction with the accompanying drawing. It is understood that the description and the drawing are given solely by way of illustrative, non-limiting example.

Figure 1:
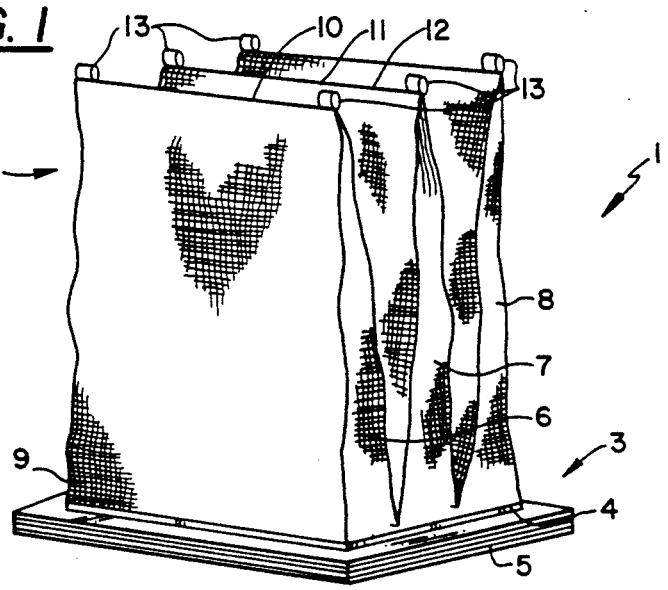
FIG. 1 is a schematic, perspective view of an assembly according to the invention, including a flexible wall with three chambers and a fixation mount.

Turning now to the drawing, a device according to the invention is shown, including an assembly 1 embodied by a bag 2 of filter cloth, which has a rim 3, such as a rigid frame 4, to the faces of which a flexible sealing gasket 5 is fastened.

The bag 2 and the rim 3 can be separable, particularly if one wishes to clean the bag 2 without the rim 3 and then reattach them to one another. In that case, fastening devices of any known type are used: shackle and bolts, clamping collar, etc., this problem being easily solvable by one skilled in the art.

The bag 2 and the rim 3 may easily form an inseparable entity, for example by duplicate-molding the gasket 5 directly onto the mouthpiece of the bag 2. The gasket 5 is made of synthetic material, the rigidity of which is selected to permit both lending a stable form to the mouthpiece of the bag and assuring flexible deformation to constitute a sealing gasket.

In that case, assemblies 1 are stored and replaced one by one as needed, with the full or used assemblies 1 being purely and simply thrown away.

The bag 2, as known per se, includes three pockets 6, 7 and 8, which taper from a common quadrangular mouthpiece 9 up to an individual apex 10, 11 and 12.

Loops 13 intended for hanging the assembly 1 in a suction device, which will now be described, are located at the apexes 10, 11 and 12.

Figure 2:
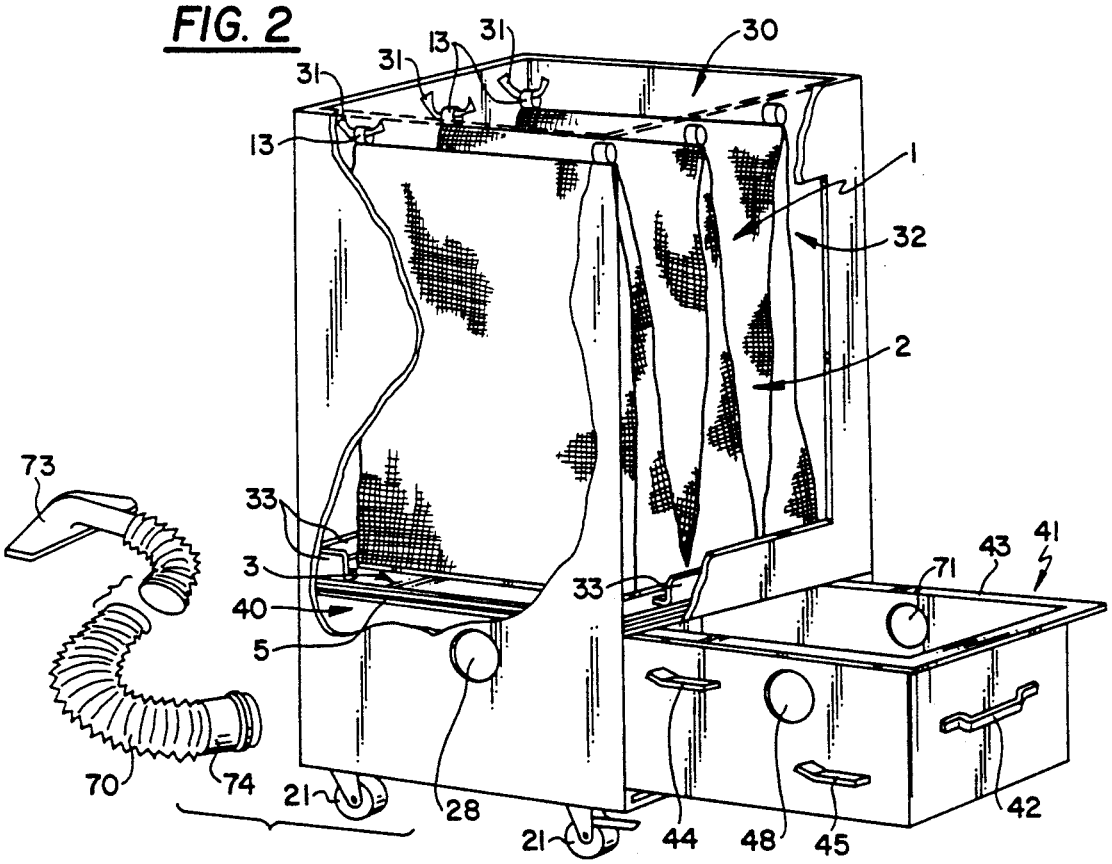
FIG. 2 is a schematic, perspective view, partly in section, of a complete device according to the invention, in which only the mechanical devices themselves (motor, turbine, etc.) have not been shown.
Figure 3:
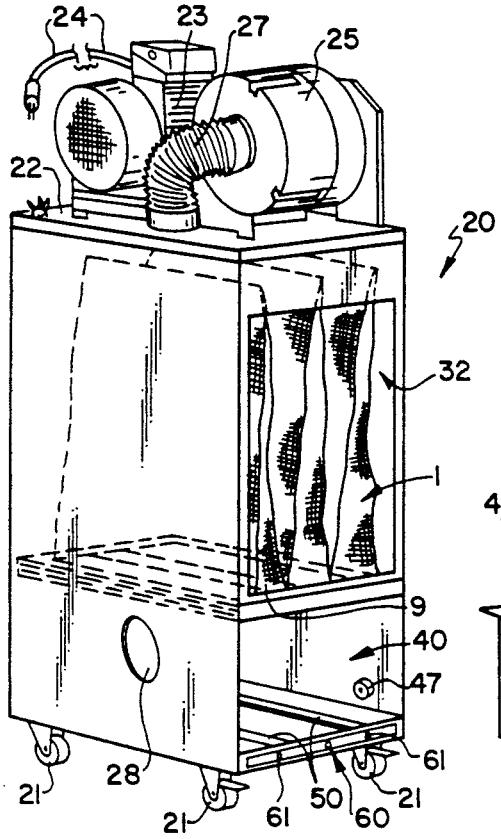
FIGS. 3 and 4 are two schematic, perspective views of a complete device according to the invention, from which a protective cap intended to hide and protect the mechanical devices (motor, turbine, etc.) has been removed.
Figure 4:
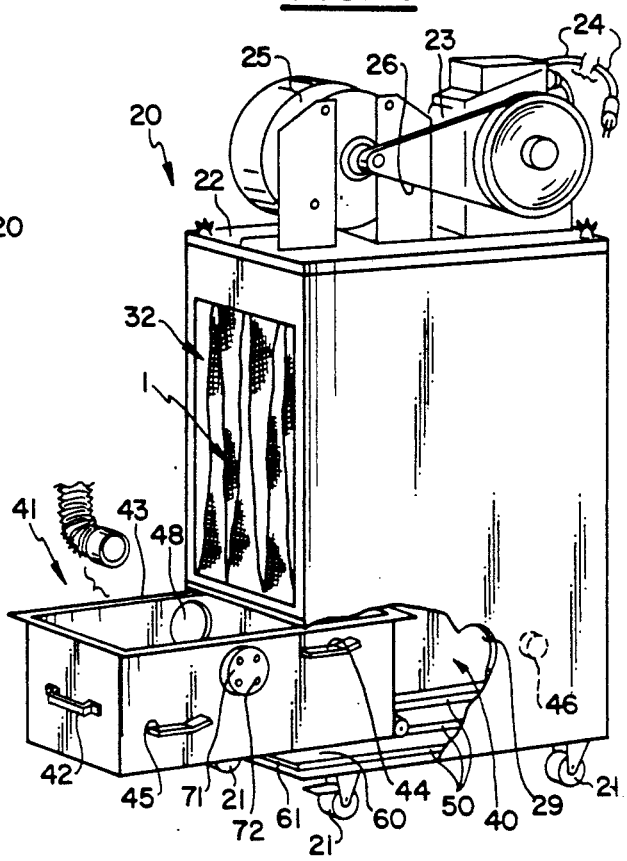

In FIGS. 2, 3 and 4, a device according to the invention is seen, including an enclosure 20 mounted on wheels 21 and closed in its upper part by a plate 22 carrying the various mechanical devices desired, including an electric motor 23 supplied with power via a cable 24 and a turbine 25 driven by the motor 23 by means of a belt 26.

The turbine is associated with a hose 27 placed facing a passage made in the plate 22 and discharging into a chamber 30 provided with hooks 31 onto which the assembly 1 is suspended by its loops 13.

In front, the chamber 30 has a window 32, which in normal service is closed off by a removable sealed plate (not shown).

Angle irons 33 are fixed to the interior of the walls of the chamber 30 to make a stop that is peripheral to the rim 3.

The assembly 1, inserted in place, defines a lower compartment 40 in which a bin 41 is mounted so that it is movable in the manner of a drawer, and it therefore has a handle 42 for maneuvering it.

The bin 41 has a continuous flat edge 43, the width of which corresponds substantially to that of the gasket 5 of the rim 3.

On its two opposed side walls, the bin 41 has two ramps 44 and 45, located at two different levels, each a little lower than the stops 46 and 47 placed inside the compartment 40. Each stop 46 and 47 is constituted by a roller mounted to pivot so as to prevent friction when they are put into action, as will be described later.

Orifices 48 pass through the side walls of the bin 41 and are located facing passages 28 and 29 made through the walls of the enclosure 20.

The compartment 40 has no bottom, to prevent any accidental accumulation of dust during manipulation of full assemblies 1 after the removal of the bin 41. However, to facilitate the movements of the bin, longitudinal slide rails 50 (FIGS. 3 and 4) are provided, on a central one of which a roller 51 rests that is mounted pivotably in front of the bin 41.

By providing that the compartment 40 has no bottom but has simple angle irons, the dust that drops down after removal of the bin 41 when the bag is changed soils the ground, which may not be very important, for example if the device is located in a garage that must necessary be cleaned particularly energetically.

In other cases, this structure may be a disadvantage, and to prevent dust from soiling the ground, a 60 is provided engaging fixed guides (not visible in the drawing) and located under the slide rails 50. It remains in place when the used assembly 1 is raised, and it is withdrawn to empty it before the new, clean assembly 1 is put in place.

The drawer is provided with buttons 61, for example, for maneuvering it.

The function of the device that has just been described is as follows:

An assembly 1 is placed in the chamber 30 by being introduced from bottom to top, via the compartment 40, after the removal of the bin 41. For greater convenience, the closure plate (not shown) that normally closes off the window 32 is removed. The loops 13 are hung on the hooks 31, and a check is made that the rim 3 is pressed against the angle irons 33, and then the closure plate is replaced on the window 32.

The bin 41 is introduced into the compartment 40 by causing its roller 51 to roll on the central slide rail 50.

Figure 5:
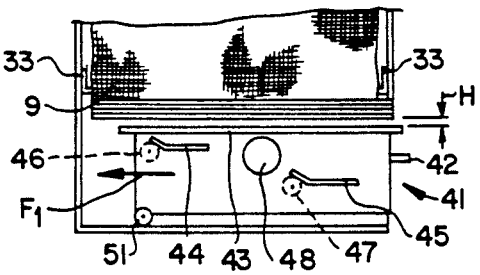
FIG. 5 is a fragmentary schematic view showing the bin in the course of being inserted.
Figure 6:
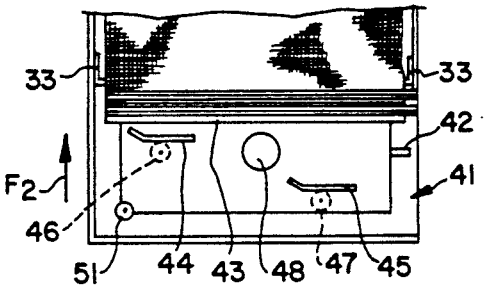
FIG. 6 is a fragmentary schematic view showing the bin in the functional position.

For the sake of simple, free motion of the bin 41, some play must remain between the edge 43 of the bin 41 and the lower face of the gasket 5 of the rim 3. This play is a space, of height H, that is visible in FIG. 5.

At the end of the movement of introduction of the bin 41 indicated by the arrow F1 (FIG. 5), the ramps 44 and 45 meet the rollers 46 and 47. The shape and disposition of the ramps 44 and 45 are selected in such a way that while continuing to push the bin 41, they are forced to pass above the rollers 46 and 46, and consequently lift the bag 41 along the arrow F2 by a distance at least equal to the height H.

The edge 43 of the bin 41 is then pressed energetically against the rim 3, compressing the gasket 5 a little bit, which assures the tight seal between the bin 41 and the bag 2.

It can be seen that with the invention, a continuous, tight enclosure is made, formed of an upper part (the flexible wall 2) and a lower part (the bin 41) without any intermediary between them except for the sealing gasket 5.

A suction hose 70 can be connected either to the orifice 48 or to the orifice 49 after the insertion of the bin 41, by using the passage 28 or the passage 29. A tape 71 fixed with bolts 72 is placed on the orifice 48 that was not selected, but the passage not used, 28 or 29, may remain open without any disadvantage, since it is located outside the bin 41. The passage used moreover has no sealed connection whatever itself with the hose 70 that is connected directly to the orifice of the bin 41.

A seal without leakage is thus achieved from a suction nozzle 73, of any known type fixed to the end of the hose 70, until the interior of the bag 2, via the interior of the bin 41.

The power cable 24 is connected, and the motor 23 is started up, either by direct action upon a switch or by using a mechanism triggered by a token, card, or coin.

The device can then be used in the way that is well known per se. The turbine 25 aspirates the air and thus creates negative pressure at the mouthpiece of the nozzle 73. The air laden with dust and impurities moves along the hose 70, arrives in the bin 41 and rises in the three pockets 6, 7 and 8 of the bag 2, which thus afford a very large surface area for the passage of the air and the retention of the dust and impurities.

In the course of usage, the bag 2 can be primed by shaking it, via the window 32, in order to empty it, causing the dust and impurities stuck to the bag 2 to drop into the bin 41. It can be seen that the dust and impurities cannot soil anything, because they cannot drop anywhere but inside the bin 41, which is connected in a sealed manner to the bag 2 via the rim 3.

When the bag 2 has become unusable because it is full or used, the hose 70 is disconnected, the bin 41 is removed and emptied, and the bag 2 is removed via the compartment 40 after the loops 13 have been unhooked.

No fixation device of any kind can impede or slow down this operation, since the bag 2 and the rim 3 are removed simultaneously.

An assembly 1 can immediately be replaced as noted above, which takes very little time. The bin 41 is put back in place and the hose 70 is reconnected, and the device is immediately operational.

If the embodiment in which the bag 2 is separable from the rim 3 is selected, then they can be separated, for example to clean and/or wash the bag 2 so that it can be reused, without losing any time in operation of the device.

If the embodiment in which the bag 2 and the rim 3 are inseparable is selected, then the assembly 1 is thrown away. This embodiment may seem more complicated, but since the gasket 5 is used only once, it can be less sturdy than if it had to be reused often, and so it can be made of a more economical material. The same is true for the bag 2, which may be relatively fragile and hence inexpensive.

The rim 3 need not include a rigid frame 4, this being solely an aid for insertion and retention of the gasket 5.

The connection 74 used for joining the hose 70 to the bin 41 may be of any known type, and its embodiment is within the skill of one skilled in the art, so that there is no need to give a complete description of it.

It will be noted in particular in FIG. 4 that the mechanical devices are particularly easily accessible, because when the protective cap (not shown) has been removed, it is possible without any difficulty to change the belt 26 or the hose 27, or to make a repair, or even to remove the motor 23 and the turbine 25, without having to use external, especially skilled manual labor.

I claim:

1. A vacuum cleaning device comprising:

an enclosure including an air outlet, a chamber having means for defining at least one flexible wall for stopping solid particles while allowing aspirated air to pass through, and a compartment containing a removable bin located under the chamber for collecting the solid particles that may drop by gravity, and sealed linking means fastened to the flexible wall for assuring a direct, tight linkage between said wall and the bin, the bin including at least one air inlet.

2. The device as defined by claim 1, wherein the flexible wall and the sealed linking means are separable from one another.

3. The device as defined by claim 1, wherein said flexible wall and the sealed linking means are inseparable and form an assembly that is interchangeable with another similar assembly.

4. The device as defined by claim 1, further including a drawer that is independent of the bin and constitutes a solid, removable bottom of the compartment.

5. The device as defined by claim 1 wherein said sealed linking means includes a flexible gasket.

6. The device as defined by claim 1, wherein said flexible wall and the bin are movably mounted one with respect to the other so that they can occupy two relative positions, in one position, said flexible wall and said bin are separated so that they can be displaced individually, and in the other positions, said flexible wall and said bin are pressed against one another in a sealed manner.

7. The device as defined by claim 6, wherein:

the bin is movably mounted in the compartment defining a drawer and mounted so as to be capable of being pressed at its periphery against said sealed linking means solidly joined to the flexible wall, and means are provided for holding said sealed linking means against the bin.

8. The device as defined by claim 7, wherein the means for holding said sealed linking means against the bin are constituted by at least one stop provided in the chamber.

9. The device as defined by claim 8, wherein the stop is constituted by a frame formed of angle irons fixed to walls of the chamber, the sealed linking means being solidly attached to the flexible wall and disposed against said frame, between said frame and the bin.

10. The device as defined by claim 6, wherein the bin has at least two ramps fixed to an outside of two opposed side walls, said ramps being disposed at a level slightly lower than the apex of corresponding stops located inside the compartment.

11. The device as defined by claim 10, wherein the stops are constituted by pivotably mounted rollers.

* * * * *